United States Patent [19]

Donington

[11] 4,350,584

[45] Sep. 21, 1982

[54] GARDEN SIEVE

[76] Inventor: Jerrold H. Donington, 87 Alexandra Dr., Surbiton, Surrey, England

[21] Appl. No.: 242,408

[22] Filed: Mar. 10, 1981

[30] Foreign Application Priority Data

Jun. 2, 1980 [GB] United Kingdom ..... 8020523

[51] Int. Cl.[3] ..... B07B 1/04

[52] U.S. Cl. ..... 209/352; 209/404; 209/413; 209/420

[58] Field of Search ..... 7/114; 280/47.31; 209/235, 352, 374, 408, 412–414, 417, 420, 421, 409, 44, 458, 415, 416, 508, 404, 375, 376; 193/5, 15

[56] References Cited

U.S. PATENT DOCUMENTS 247,077 9/1881 Lodwick ..... 209/458 X
517,724 4/1894 Beers ..... 209/413
1,424,451 8/1922 Crandall ..... 209/421 X

FOREIGN PATENT DOCUMENTS 556352 9/1943 United Kingdom ..... 209/417
874540 8/1961 United Kingdom .

*Primary Examiner*—Ralph J. Hill
*Attorney, Agent, or Firm*—Cushman, Darby & Cushman

[57] ABSTRACT

A garden sieve for mounting on a wheelbarrow has a frame and a stand adapted for detachable connection by means of selectively engageable projections and recesses, with the frame in any one of a series of positions whereby the extension and/or angular position of the stand relative to the frame is adjustable. In the preferred embodiment the stand has two arms, the free ends of which engage opposite sides of the frame near one end thereof and the other end of the frame carries clips intended in use, to fit over an edge of the wheelbarrow.

5 Claims, 11 Drawing Figures

GARDEN SIEVE

This invention relates to a sieve and more particularly to a garden sieve for mounting on a wheelbarrow.

According to this invention we propose a sieve for mounting on a wheelbarrow, comprising a frame and a stand adapted for detachable connection with the frame in any one of a series of positions whereby the extension and/or the angular position of the stand relative to the frame is adjustable. In a preferred embodiment, the stand has projections or recesses at intervals along its length and the frame has complementary recesses or projections, adjustment of the relative disposition of the frame and the stand being possible by engaging selected projections and recesses.

An embodiment of this invention will now be described by way of example with reference to the accompanying drawings of which:

FIG. 1 is a perspective view of an assembled garden sieve according to the invention;

FIGS. 2*a–d* comprise respectively top plan, end elevation, side elevation and perspective views of the frame of the sieve shown in FIG. 1;

Figure 1:
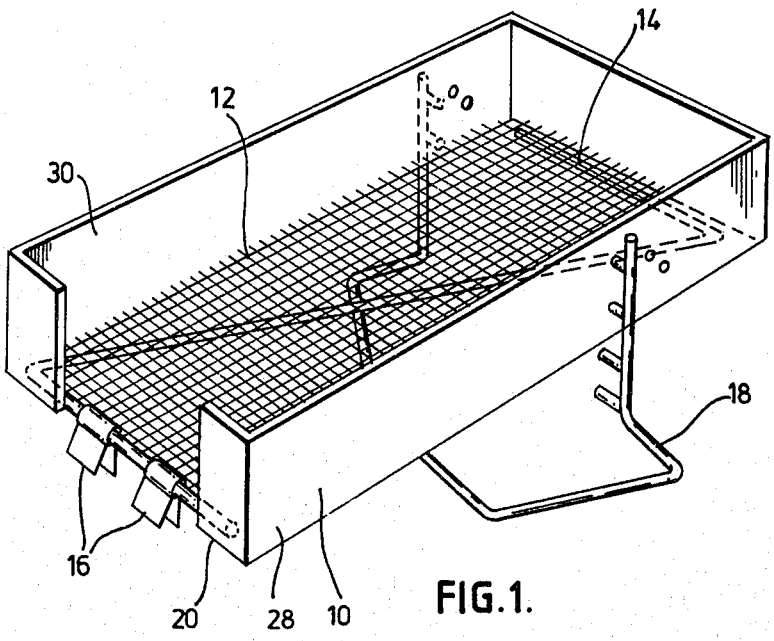

The garden sieve shown in FIG. 1 is made up of six parts; a frame 10, a sheet 12 of wire mesh, a Z-shaped reinforcing rod 14, two spring clips 16 and a stand 18 for adjusting the height and inclination of the sieve.

In order to strengthen the frame 10 which as seen from FIGS. 2*a*–2*d* is open at one end, the Z-shaped rod 14 is secured by welding or otherwise, to its bottom edge 20 and serves also to support the wire mesh 12 in the middle of the frame.

Figure 3:
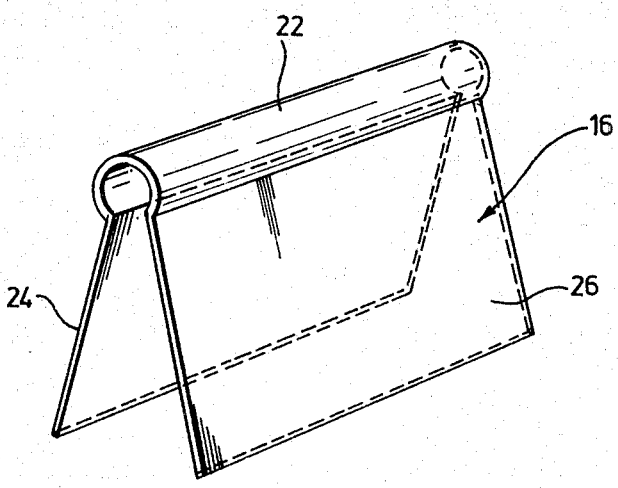
FIG. 3 is a perspective view of one of the two clips shown in FIG. 1, for attaching the sieve to the front edge of a wheelbarrow.
Figure 2A:
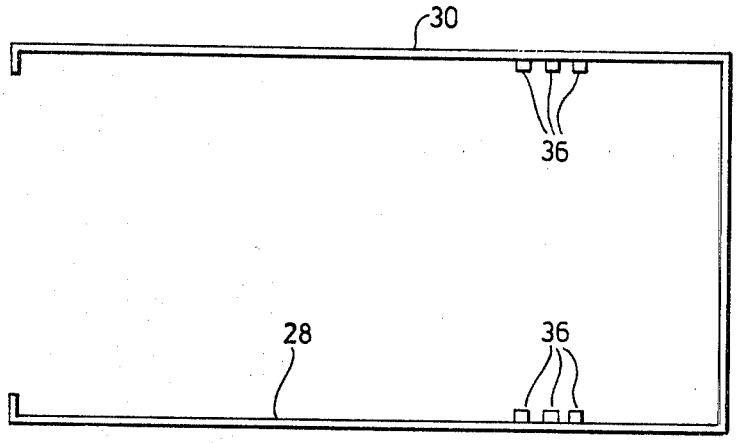
Figure 2C:
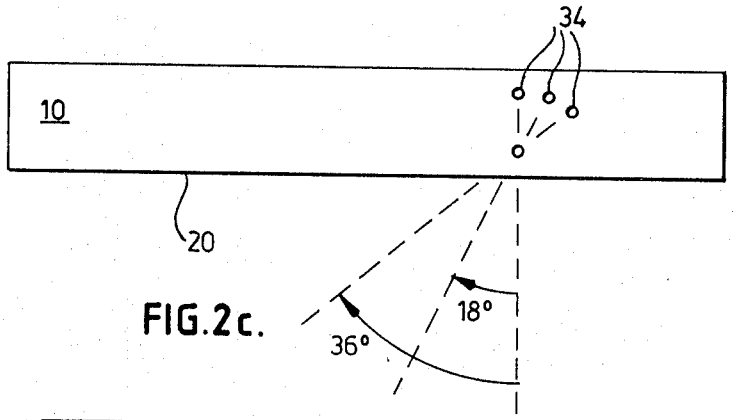
Figure 2B:
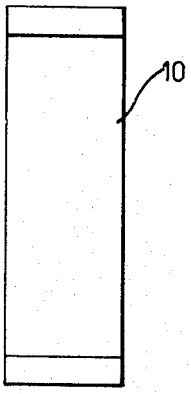
Figure 2D:
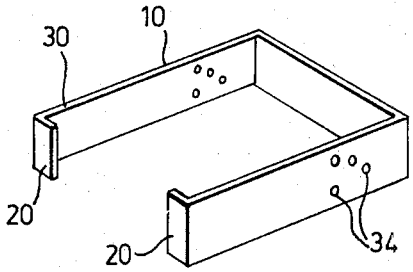

Each spring clip 16 has a hollow spine 22 from which extend leaves 24 and 26. The spines 22 of clips 16 pivotably receive the rod 14, where it crosses between the two side walls 28 and 30 at the open end of the frame 10 to permit the chips to be fitted over the edge of a wheelbarrow (not shown in FIG. 3) at any desired inclination.

Figure 4:
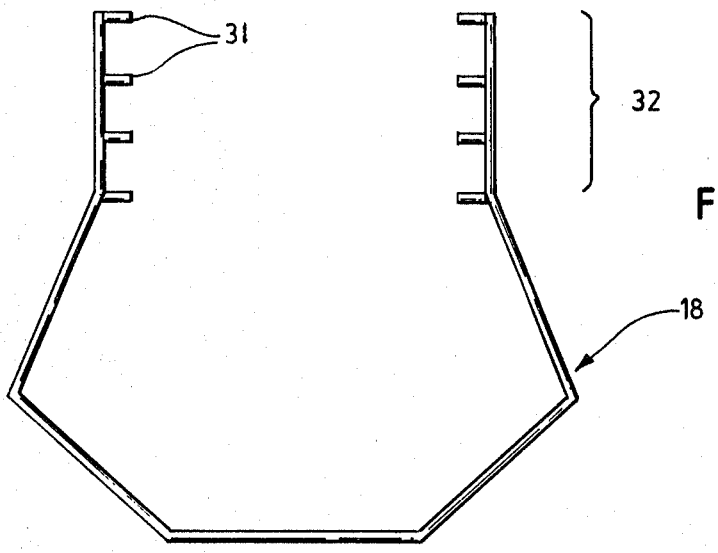
FIG. 4 shows the adjustable stand used to support the sieve of FIG. 1 in a desired inclined position above a wheelbarrow.

Adjustment of the inclination and/or height of the sieve is achieved by means of a series of spigots 31 spaced at intervals along the free end portions 32 of the stand 18 (see FIG. 4), which engage holes 34 formed in the side walls 28 of the frame. In each side wall, the arrangement of holes is identical, there being four holes of which three are angularly spaced along the circumference of a circle the center of which coincides with the fourth hole. The radius of this circle, that is to say the distance between the fourth hole and each of the others, is equal to the center distance between adjacent spigots 31 on the stand, so that in any one of the three angular settings of the frame relative to its support, two spigots 31 engage holes 28 on each side of the frame.

At least the fourth hole is fitted with a bush 36 to strengthen the connection with the stand 18 but in FIG. 2 such bushes are fitted in all of the holes 34. It will be appreciated that a similar effect is achieved if the arrangement of holes 34 is inverted; that is to say if the fourth hole is uppermost.

Figure 5:
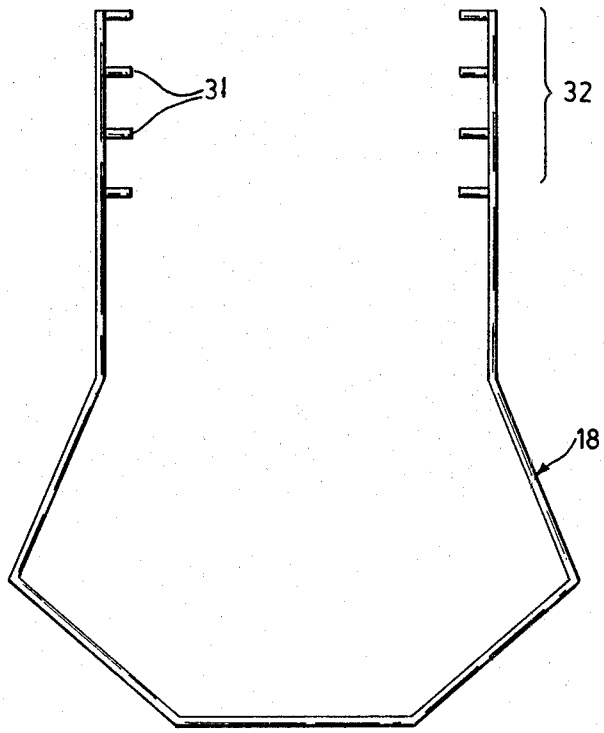
FIG. 5 shows a modified form of stand.

In use, the frame 10 is placed on top of the wheelbarrow with the spring clips 16 fitted over the edge of the front wall, the stand 18 resting against or standing on the side walls, the inclination and height of the sieve being determined by the engagement of selected spigots and holes. If further adjustment is required the foot may have more spigots or a taller stand such as shown in FIG. 5.

Figure 6:
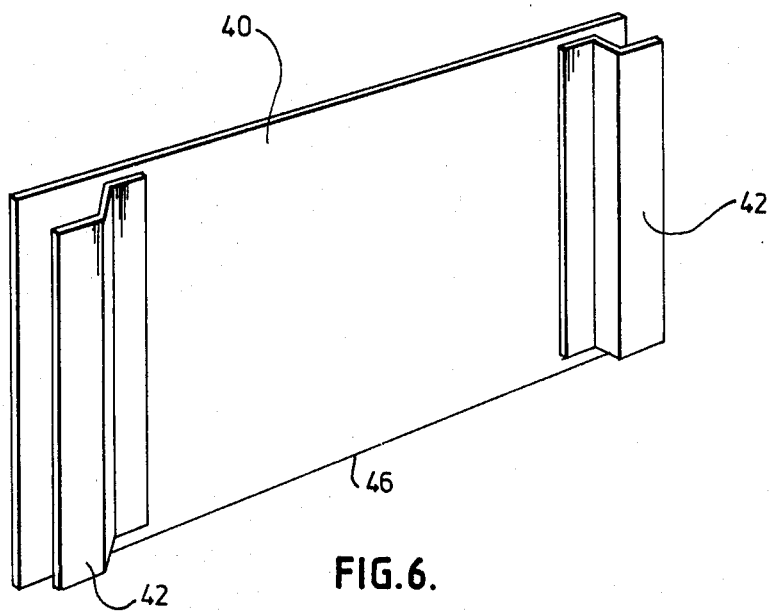
FIG. 6 is a perspective view of a plate that can be temporarily affixed to the frame of the sieve shown in FIG. 1.
Figure 7:
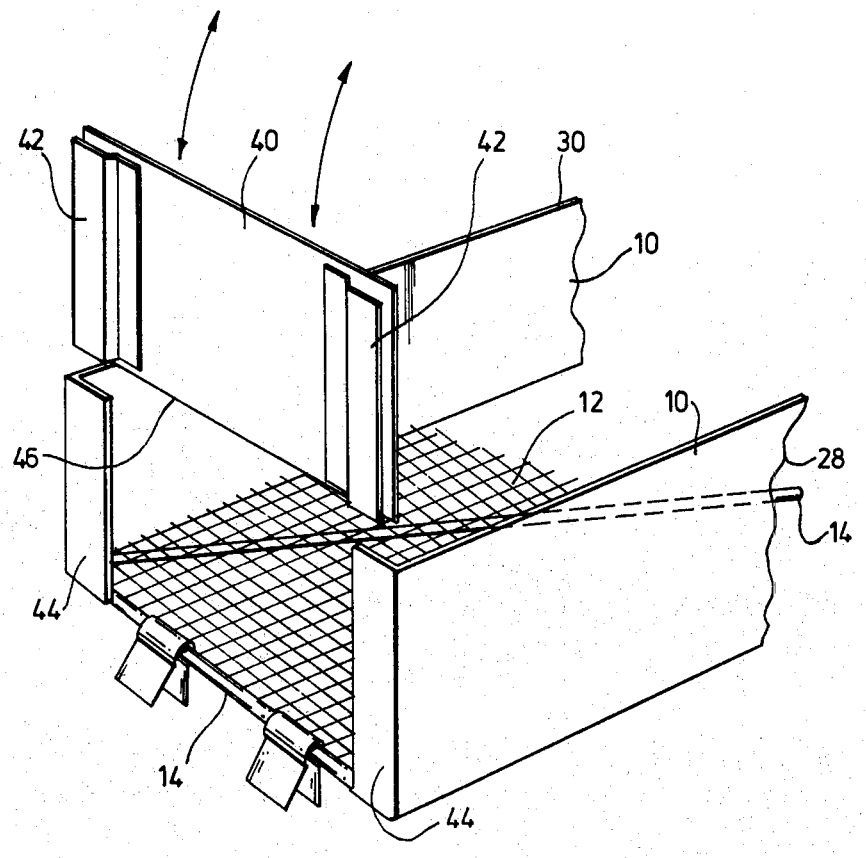
FIG. 7 is a perspective view showing the method of affixing the plate to the frame.

FIGS. 6 and 7 show details of a modified embodiment of garden sieve comprising an optional seventh component, namely a plate 40 which acts as a temporary collector of coarse material, such as stones, obtained by separating coarse from fine material in the sieving process. The plate 40 may be freely affixed to, and disconnected from the open end of the frame 10 of the sieve during use.

The plate 40 has one or more brackets 42 at each end affixed by welding or other means. The brackets 42 fit to the lips 44 of the front of the side walls 28, 30 of the frame 10. The bottom edge 46 of the plate sits on top of the Z-shaped rod 14 and/or the sheet of wire mesh 12 in the gap formed by the open end of the frame 10.

Figure 8:
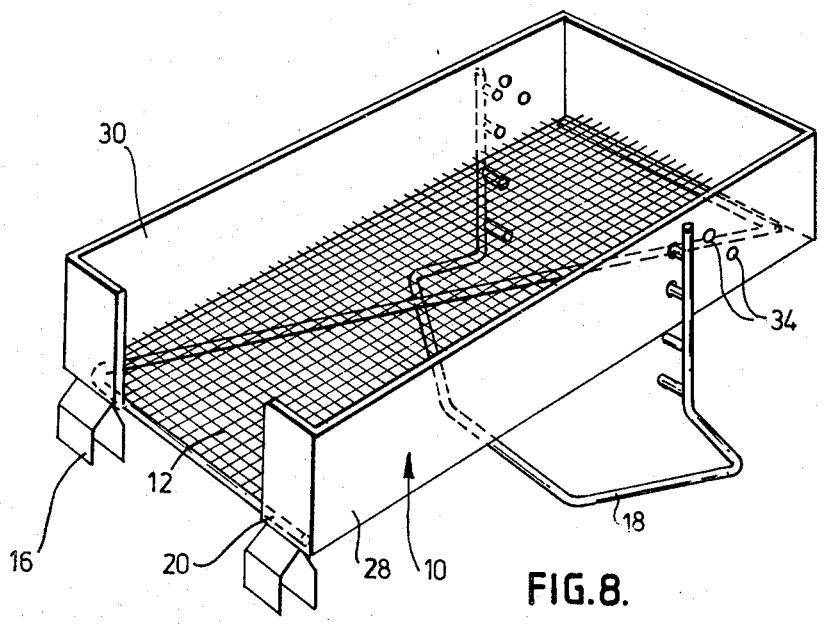
FIG. 8 is a perspective view of another embodiment of the sieve according to this invention.

In an alternative embodiment, the spring clips 16 are welded or otherwise affixed to the Z-shaped reinforcing rod or to the front of the bottom edge 20 of the frame as shown in FIG. 8.

Further, the frame 10 may have an inwardly projecting lip or flange around its bottom edge. The periphery of the wire mesh sheet 12 is affixed by welding or clamping or in any suitable manner either on top of the lip (i.e. within the frame) or to the underside thereof.

I claim:

1. A sieve comprising:

a frame;

a mesh mounted in said frame; and a stand having at least two equally spaced interconnection means;

said frame having at least two interconnection means spaced along a circumference of a circle and an additional interconnection means disposed at the center of said circle, the radius of said circle equaling the distance between said stand interconnection means, one of said stand interconnection means detachably interconnecting with said additional interconnection means and an adjacent one of said stand interconnection means detachably connecting with one of said frame interconnection means for detachably connecting said stand to said frame in any of a plurality of positions.

2. A sieve according to claim 1 wherein the detachable connection between the frame and the stand is nearer to one end of the frame than the other end and wherein the frame carries, at the said other end, clips intended, in use, to fit over an edge of a wheelbarrow.

3. A sieve according to claim 1 or 2 wherein:

said stand interconnection means are projections on said stand; and said frame interconnection means are recesses in said frame.

4. A sieve according to claim 1 or 2 wherein:

said frame has a partially open end; and said sieve further comprises a plate and bracket means attached to said plate for removably attaching said plate to said frame to cover said open end.

5. A sieve according to claim 1 or 2 further comprising:

supporting means including a rod extending diagonally across said frame, under said screen, for strengthening said frame and supporting said screen.

* * * * *